United States Patent [19]

Crosby et al.

[11] Patent Number: 5,005,508

[45] Date of Patent: Apr. 9, 1991

[54] ANCHOR ASSEMBLY

[75] Inventors: Peter W. Crosby; Henry W. Schenk, both of Buffalo, N.Y.

[73] Assignee: The Crosby Company, Buffalo, N.Y.

[21] Appl. No.: 409,807

[22] Filed: Sep. 20, 1989

[51] Int. Cl.[5] ..... B63B 21/44

[52] U.S. Cl. ..... 114/309; 114/301; 114/304

[58] Field of Search ..... 114/294, 301, 302, 303, 114/304, 305, 306, 307, 308, 309, 310

[56] References Cited

U.S. PATENT DOCUMENTS

| | | | |
|---|---|---|---|
| 536,177 | 3/1895 | Baker . | |
| 730,009 | 6/1903 | Duncanson . | |
| 2,480,188 | 8/1949 | Gardiner | 114/304 |
| 2,987,028 | 6/1961 | Fair | 114/309 |
| 3,190,252 | 6/1965 | Keepers | 114/309 |
| 3,518,957 | 7/1970 | George . | |
| 3,529,563 | 3/1969 | Fast . | |
| 3,774,569 | 10/1971 | Linnenbank . | |
| 3,782,318 | 1/1974 | Hungerford | 114/309 |
| 4,263,867 | 4/1981 | Holmes | 114/304 |
| 4,651,669 | 3/1987 | Albertini et al. | 114/309 |
| 4,676,184 | 6/1987 | Ogg | 114/304 |
| 4,700,652 | 6/1986 | Pekny . | |
| 4,763,597 | 8/1988 | Stupakis | 114/303 |

FOREIGN PATENT DOCUMENTS

| | | |
|---|---|---|
| 1145047 | 3/1977 | Fed. Rep. of Germany . |
| 205140 | 10/1923 | United Kingdom . |
| 1067382 | 5/1967 | United Kingdom . |

*Primary Examiner*—Sherman Basinger
*Assistant Examiner*—Thomas J. Brahan
*Attorney, Agent, or Firm*—Hodgson Russ Andrews Woods & Goodyear

[57] ABSTRACT

An improved anchor assembly of the Danforth type. The crown is formed from a single piece of rectangular tubing by a pressing operation to form a crown having two parallel inwardly disposed sidewalls and, at generally right angles thereto, two sidewalls which extend towards each other in a forward direction. Right-hand and left-hand flukes are each formed from a single piece of metal plate material and have a triangular plate portion and flange portion which extends to either side of the plate portion at right angles thereto. Extensions of the flange are welded to the parallel sidewalls of the crown box. The rear end of a shank, which is formed from square bar stock, is disposed within the crown box with an aperture in the shank being in alignment with corresponding apertures in the flange extensions of the flukes and the parallel sidewalls of the crown box. A stock is inserted through the apertures so that the shank can pivot about an intermediate portion of the stock. The rear edge of the flukes are welded to the stock material inwardly of the ends of the stock. The foregoing construction utilizes significantly fewer parts than prior art Danforth type anchors, is easier to assemble than such prior art designs, and is correspondingly less costly to manufacture.

6 Claims, 3 Drawing Sheets

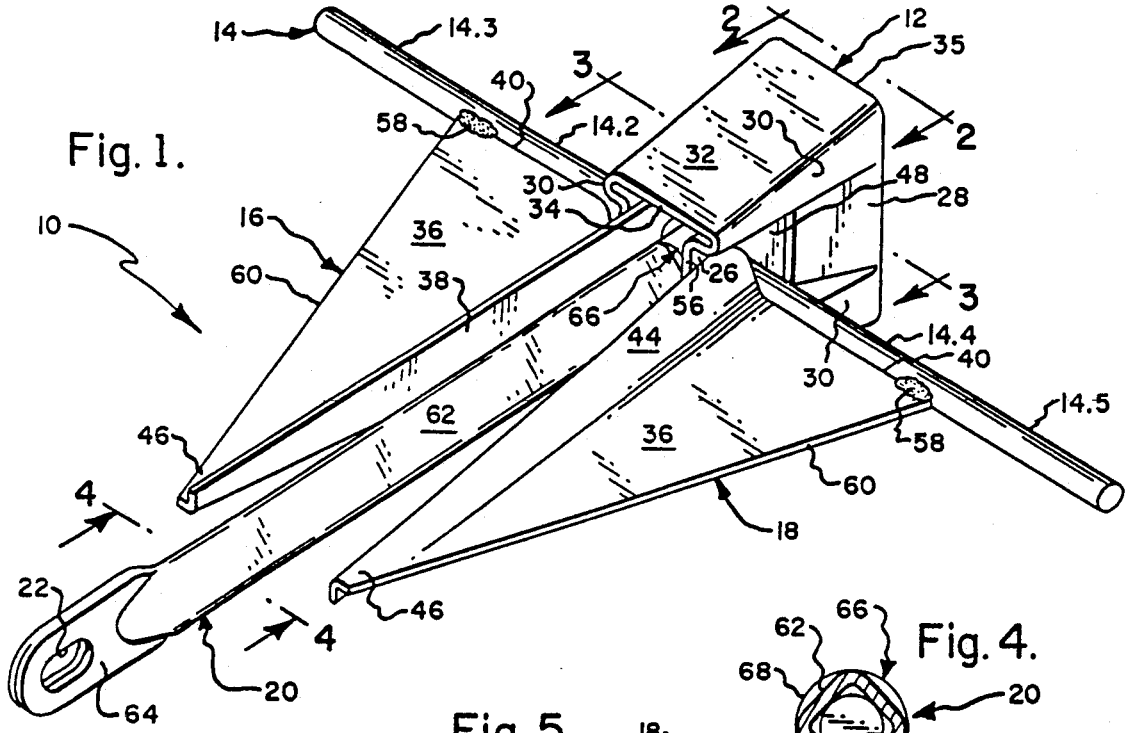
Fig. 1.
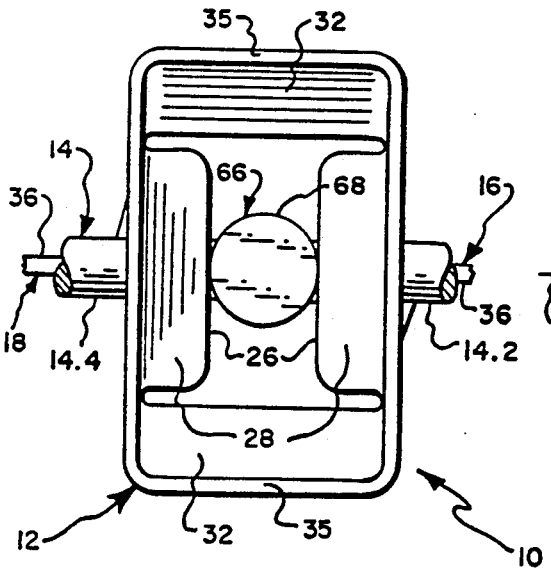
Fig. 2.
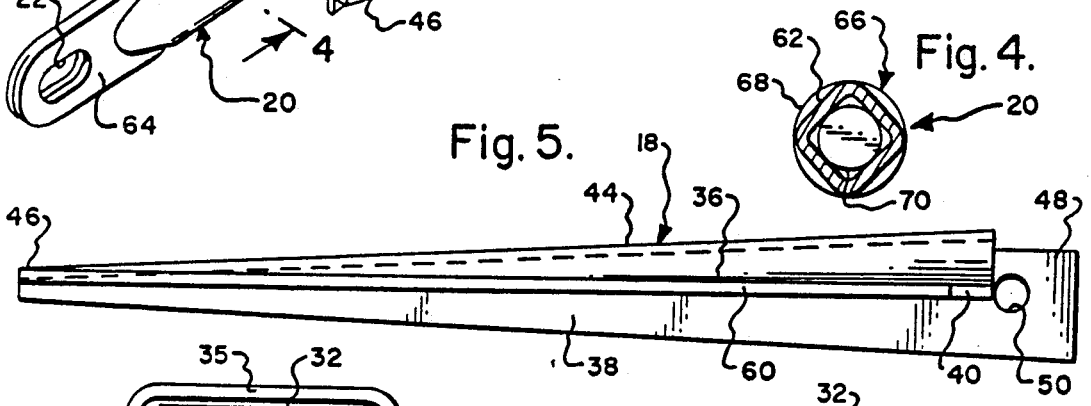
Fig. 5.
Fig. 4.
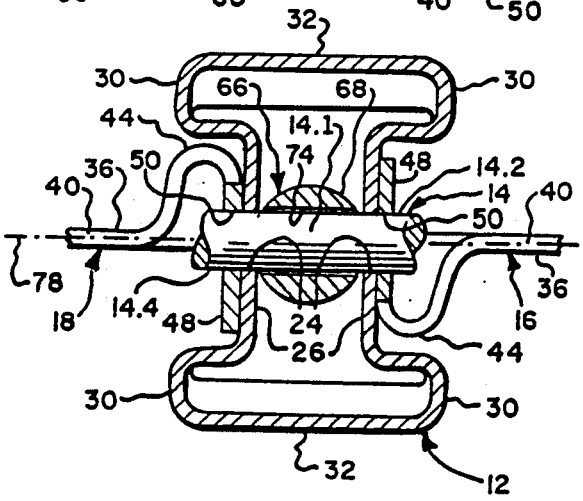
Fig. 3.

Fig. 6.
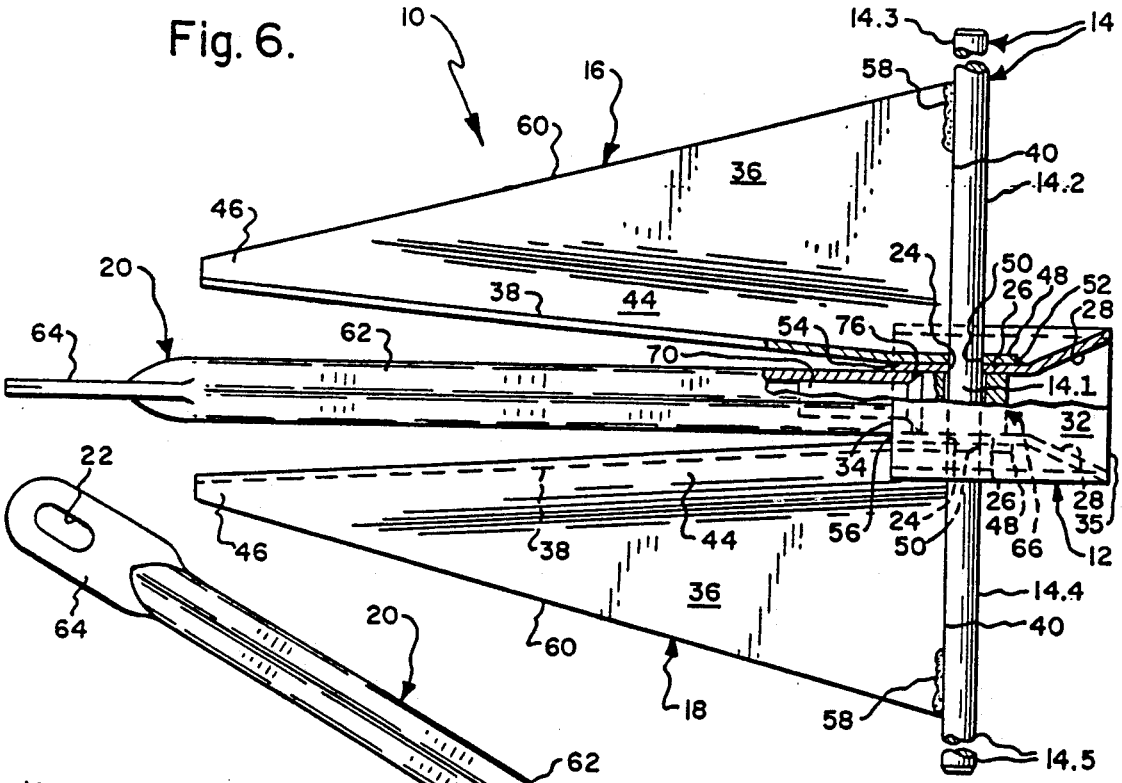
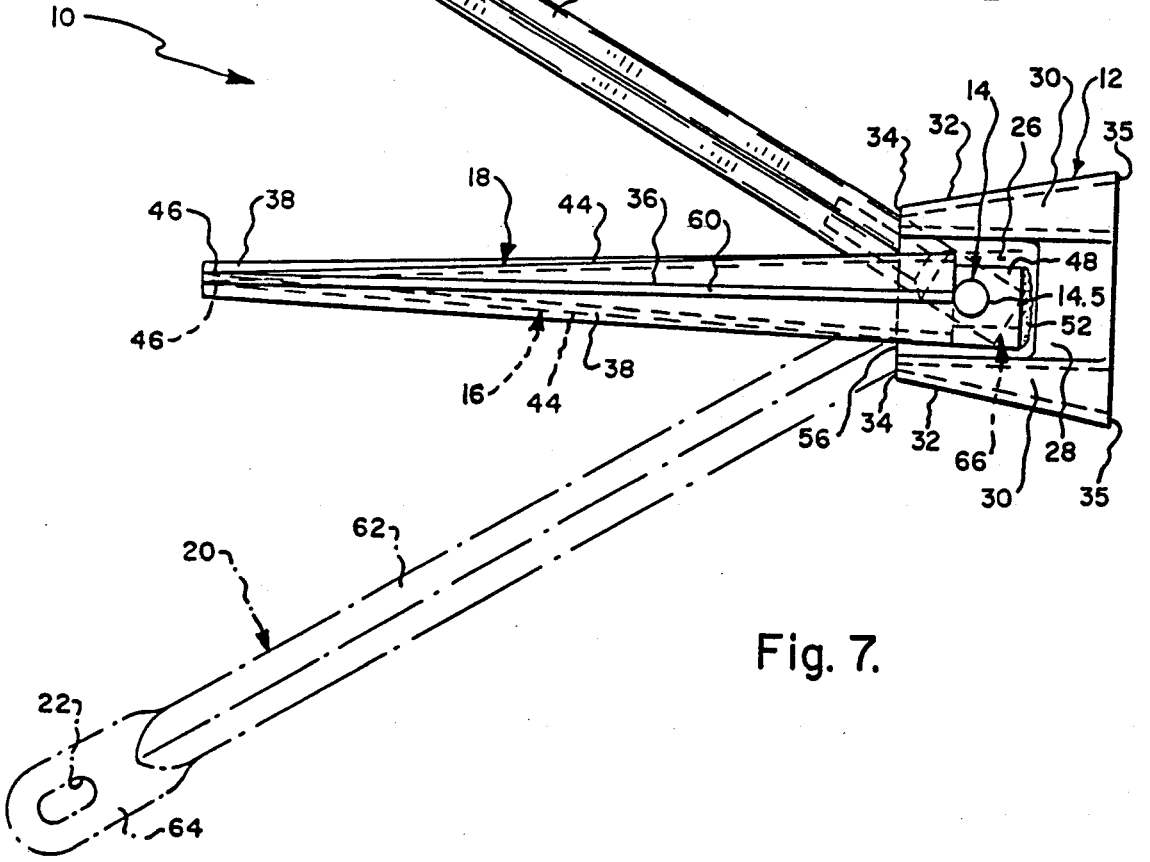
Fig. 7.

14.3
14
35
12
10
30
32
28
26
34
24
56
14.5
40
60
50
48
9
16
36
38
44
10
11
46
12
18
68
74
72
70
66
20
62
22
64

42

ANCHOR ASSEMBLY

TECHNICAL FIELD

The present invention relates generally to an improved anchor assembly, and more particularly to an improved anchor assembly of the well-known Danforth type which utilizes significantly fewer parts and costs less to manufacture.

BACKGROUND OF THE INVENTION

One of the most successful anchors in use today is the Danforth type anchor which includes a shank having an eye at one end, the other end being pivotally secured to a stock which extends through a crown box, the anchor further including right-hand and left-hand flukes which extend towards the eye on the shank, the front end of each fluke terminating in a bill and the rear end of each fluke being rigidly secured to the crown box and the stock. The crown box limits the amount of pivoting of the shank to approximately 30° to either side of a mid-point, thus permitting the bills of the flukes to dig into the bottom. This form of anchor, while performing very successfully, has the disadvantage in that its assembly is relatively complex. Thus, each of the flukes is made from a fluke plate and a flange plate which extends at right angles to the fluke, the two parts being welded to each other. The crown box is also an assembly of a number of components which must be precisely welded to each other. Because of the number of parts which must be welded together the costs of Danforth type anchor tend to be higher than those which can be made with less assembly time.

OBJECTS AND SUMMARY OF THE INVENTION

It is a principal object of the present invention to provide an improved anchor asembly which overcomes the disadvantages of prior art Danforth type anchors.

More particularly, it is an object of the present invention to provide an anchor assembly including a crown, stock, and right- and left-hand flukes which are interconnected to each other, wherein each of the component parts is formed from a single piece of material.

The foregoing is achieved by providing a crown box which is pressed to its final shape from a single piece of metal tubing, and wherein each of the flukes is formed from a single piece of pressed metal plate.

The foregoing construction, as well as additional objects and advantages of this invention will be more fully understood after a consideration of the following detailed description taken in conjunction with the accompanying drawings in which a preferred form of this invention is illustrated.

BRIEF DESCRIPTION OF THE DRAWINGS

FIG. 1 is a perspective view of an anchor assembly made in accordance with the principles of this invention.

FIG. 2 is a view taken generally along the line 2—2 in FIG. 1.

FIGS. 3 and 4 are sectional views taken generally along the line 3—3 and 4—4 in FIG. 1.

FIG. 5 is a side elevational view of the left-hand fluke shown in FIG. 1.

FIG. 6 is a plan view of the anchor assembly shown in FIG. 1.

Figures 8, 9, 10, 11, 12:
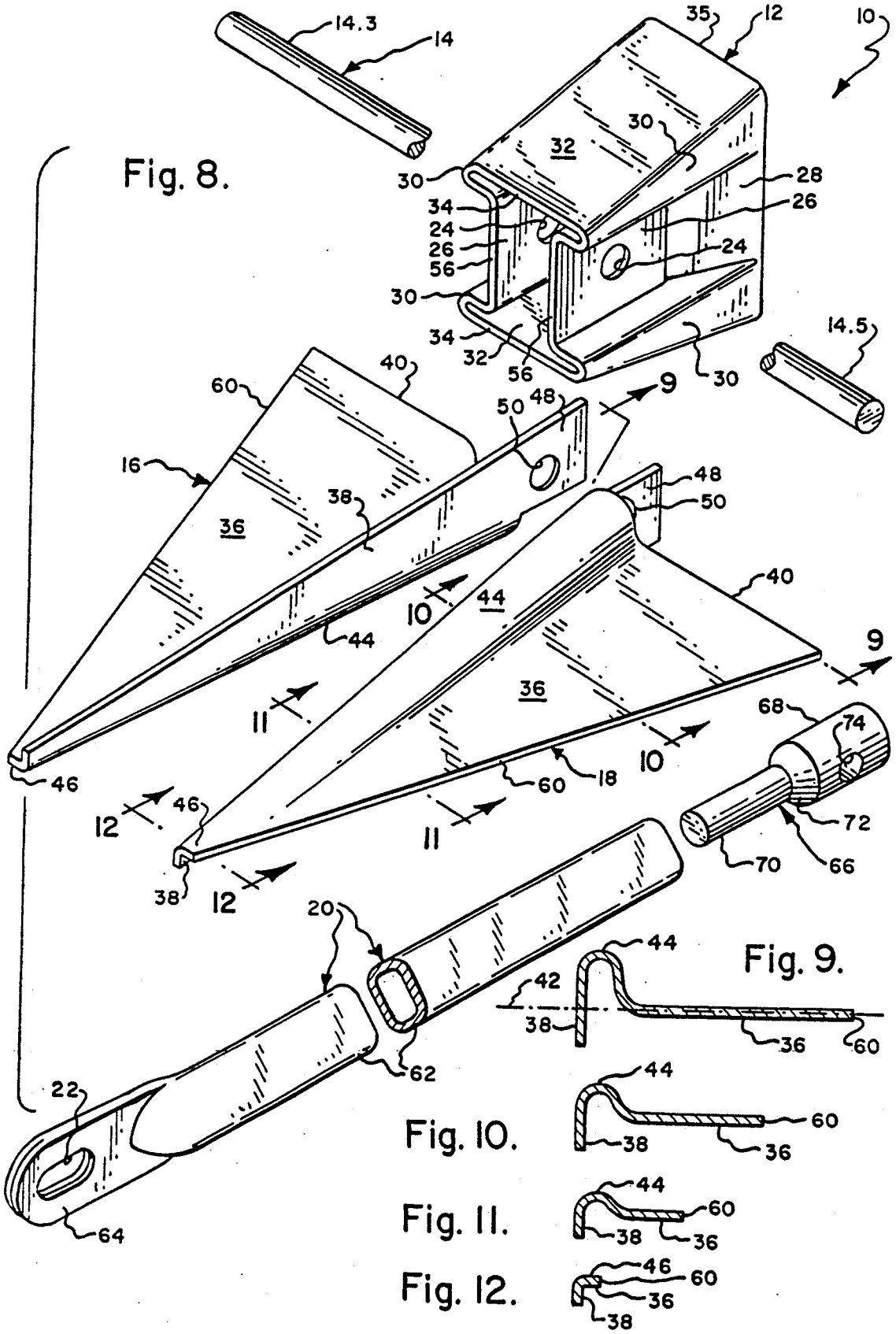

FIG. *6a* is an enlarged sectional view taken on line *6a—6a* of FIG. 7.

FIG. 7 is a side elevational view of the anchor assembly shown in FIG. 1 with the shank being shown in one position of limited movement in full lines and being shown in its other position of limited movement in broken lines.

FIG. 8 is an exploded perspective view of the anchor assembly shown in FIG. 1.

FIGS. 9 through 12 are sectional views taken generally along the lines 9—9, 10—10, 11—11 and 12—12 in FIG. 8.

DETAILED DESCRIPTION

First, with reference to FIG. 1, the anchor assembly of this invention is indicated generally at 10. As is conventional, the anchor assembly consists of a number of well-known components, these being a crown or crown box indicated generally at 12, a stock 14 formed of an elongated bar of metal of circular cross-section, right-hand and left-hand flukes indicated generally at 16 and 18, respectively, the flukes being welded or otherwise rigidly interconnected with the crown and the stock, and a shank indicated generally at 20, the shank being provided with an eye 22 at one end, and the other end of the shank being pivotally secured to the stock within the crown box.

The stock 14 of the anchor assembly of this invention does not differ materially from prior known stocks. Thus, the stock includes a mid-portion 14.1 (FIG. 3) disposed within the crown 12 and right- and left-hand outwardly extending portions, each of the outwardly extending portions being divided into an inner section and an outer section. Thus, the right-hand outwardly extending portion of the stock has an inner section 14.2 (FIG. 1) and an outer section 14.3. Similarly, the left-hand outwardly extending portion has an inner section 14.4 and an outer section 14.5.

In accordance with this invention the crown 12 is formed from a single piece of rectangular tubular stock. Initially in the formation of the crown a measured length of tubular stock of rectangular cross section is cut to form a workpiece. The rectangular tubular workpiece initially has two pairs of parallel sidewalls at right angles to each other. Opposed apertures 24 (FIG. 8) are then drilled in the first pair of spaced-apart parallel sidewalls which may also be referred to as the fluke sides. The cut and drilled workpiece is then subjected to a two-step pressing operation, a mandrel (not shown) being received within the workpiece during the second press forming step. After the initial forming steps it can be seen that parallel portions 26 of the first pair of sidewalls have been shifted inwardly towards each other, and that a rear tapered section 28 has been formed to the rear of each parallel portion 26, and also that folded connecting portions 30 have been formed to the sides of each parallel portion. Also, the rear end of the crown box is essentially non-deformed having the initial rectangular cross section of the workpiece from which the crown is made, this best being illustrated in the rear view shown in FIG. 2. However, the forward end of the crown box has been pressed into the form best shown in FIG. 8 wherein the forward edges 34 of the spaced-apart sidewalls 32 overlie the folded portion 30 and are disposed more closely to each other than the rear edges 35.

The work hardened crown box which is formed in the above manner has a very high strength to weight ratio, requires little labor to manufacture, and is not wasteful of materials in its manufacture. As previously indicated, prior art crown boxes for this type of anchor have been made from an assembly of various parts requiring extensive labor in their manufacture as each part must be precisely cut to its final size and then welded into its assembled relationship with the other parts while maintaining a certain tolerance range. In this design, because a press and forming mandrel are utilized, a high degree of uniformity is obtained with minimal manual labor.

Also, in accordance with this invention, each of the right-hand and left-hand flukes, which are substantially identical with each other, are formed in a novel manner. Thus, these flukes are not formed from a welded assembly, but each of these flukes is pressed from a single piece of metal plate material, the metal plate material preferably being a high strength steel. As can best be seen from FIG. 8, as well as FIGS. 5 and 9 through 12, each of the flukes includes a triangular plate portion 36 and a flange portion 38 at right angles thereto which, at least adjacent the base 40 of the triangular portion 36, extends generally equidistantly to either side of the plane of the triangular portion, the plane being indicated by the dot-dash line 42 (FIG. 9). A connecting portion 44 extends between the flange portion 38 and the triangular portion 36 of each fluke, except in the area of the tip or bill 46 of the triangular portion, the connecting portion being in the shape indicated in the drawings so that, for at least a substantial length, the flange 38 extends to either side of the plane 42, and also to avoid any sharp edges. As can be seen each fluke is provided with a rear extension 48 of the flange 38, the extension being at a slight angle to the flange 38. The extension is provided with an aperture 50. The extension is so dimensioned that it may lie against the parallel portions 26 of the crown box.

The rear edge of each extension 48 is welded to the surface of an associated parallel portion 26 by a weld 52 (FIG. 6). Similarly, a further weld 54 secures the rear end of the flange 38 to the forward edge 56 of an associated parallel portion 26. As can best be seen from FIG. 1 the base 40 of each of the right-hand and left-hand flukes is welded to the inner section 14.2 or 14.3 of the associated outwardly extending portion of the stock by a weld 58. While each of the right-hand and left-hand welds 58 is shown extending inwardly only a short distance from the outer edge 60 of the associated fluke 16 or 18, it should be appreciated that these welds can extend for the full length of the distance of the associated base 40. The welds 52, 54 and 58 are all that are necessary to complete the assembly of the stock, crown and flukes, and considerably less weld material is used than in prior art designs. The complete manner of assembly is set forth below.

The shank 20 of this invention is formed from bar stock which is square in cross-section. In one size of anchor, it may be formed from ¾-inch square stock. The eye end is pressed to form a generally planar portion 64 which extends generally from one corner to another, the eye end then being provided with the elongated eye 22, which eye may be formed by a punching operation. The eye-end edge is then ground to the shape indicated in the drawings. The crown end of the shank is also pressed to form a generally planar portion 66 which also extends generally from one corner to the other. A hole 68 is then punched out of a central part of the stock so that the mid-portion 14.1 of the stock 14 can be pivotally received therein. The crown end edge 70 is ground to the shape indicated in the drawings. In addition, opposed flats 72 are also ground in the corners of the stock in the locations indicated in the forward end of 34 of the crown when the parts are in the position shown in full lines in FIG. 7.

The parts are completely assembled by welding the right-hand and left-hand flukes to the crown by welds 52 at the rear of the extensions 48 and by also by the welds 54, the apertures 50 and 24 being in alignment with each other. The shank assembly is now disposed within the crown-fluke assembly with hole 68 in the crown end of the shank in alignment with the apertures 50 and 24. The stock 14 is then extended through the apertures 50, 24, and 68, the stock then being welded in the manner being indicated to the right- and left-hand flukes by welds 58. It can therefore be seen that the stock, flukes, and crown are formed into a rigid assembly. However, the shank assembly can pivot with respect to these elements from the full line position shown in FIG. 7 to the dotted line position also shown in FIG. 7 about the pivot axis indicated by the dot-dash line 74 in FIG. 3.

By utilizing the principles described above and shown in the accompanying drawings, it is possible to provide a novel anchor assembly which may be made in a better manner than prior anchor assemblies, which will have a high strength to weight ratio, and which will be of lower cost.

While a preferred structure in which the principles of the present invention have been incorporated is shown and described above, it is to be understood that the invention is not to be limited to the particular details, shown and described above, but that, in fact, widely differing means may be employed in the practice of the broader aspects of this invention.

What is claimed is:

1. An anchor assembly having a crown box, a stock extending through and to either side of the crown box, a pair of opposed flukes, and a shank assembly having one end pivotally secured to the stock within the crown box; characterized in that each fluke of the pair of opposed flukes is substantially identical with the other, each fluke being formed from a single piece of sheet metal, the sheet metal after forming including a triangular flat plate portion and a flange portion to one side of the triangular plate portion, a section of the flange portion being at substantially right angles to the flat plate portion, the flange portion being bent in such a manner that it extends equally either side of the flat portion, the base of the triangular plate portion of each fluke being secured to the stock to one side of the crown box, with the flange portion being disposed adjacent the shank assembly.

2. The anchor assembly as set forth in claim 1 wherein the flange portion of each fluke includes an intermediate curved connection portion of a generally S-shape which extends between the right angle section of the flange portion and the triangular plate portion.

3. The anchor assembly as set forth in claim 1 where each flange portion is provided with an extension which extends to the rear of the base of the triangular plate portion, the extension of the flange portion of each of the pair of opposed flukes being secured to the crown box, and an intermediate portion of the stock extends through the extensions of each flange portion.

4. The anchor assembly as set forth in claim 1 further being characterized in that the crown box is formed from a single section of metal tubing having opposed openings, the shank extending through one of the openings, the crown box having first and second pairs of spaced-apart sidewalls, the second pair of spaced-apart sidewalls having a shank eye edge and a rear edge, the first pair of spaced-apart sidewalls being parallel to each other and being provided with aligned apertures, the shank eye edge of the second pair of sidewalls being closer to each other than the rear edge of the second pair of sidewalls, the first and second pairs of sidewalls being connected to each other by connecting portions of the tubing.

5. The anchor assembly having a crown box, a stock, a pair of opposed flukes secured to the crown box and stock, and a shank assembly having one end pivotally secured to the stock within the crown box; characterized in that the crown box is formed from a single section of metal tubing having opposed openings, the shank extending through one of the openings, the crown box having first and second pairs of spaced-apart sidewalls, the second pair of spaced-apart sidewalls having a shank eye edge and a rear edge, the first pair of spaced-apart sidewalls being parallel to each other and being provided with aligned apertures, the shank eye edge of the second pair of sidewalls being closer to each other than the rear edge of the second pair of sidewalls, and the first and second pairs of sidewalls being connected to each other by connecting portions of the tubing, the stock extending through the aligned apertures in the first pair of opposed sidewalls.

6. The anchor assembly as set forth in claim 5 further characterized by each of the flukes being provided with a triangular flat plate portion and a flange portion, each fluke being formed from a single piece of sheet metal plate, and wherein the flange portion of each fluke is secured to one of said first pair of spaced-apart parallel sidewalls.

* * * * *